United States Patent [19]

Berry

[11] 4,018,273

[45] Apr. 19, 1977

[54] MANDREL LOCKING SLEEVE

[75] Inventor: Robert Frank Berry, Houston, Tex.

[73] Assignee: Dresser Industries, Inc., Dallas, Tex.

[22] Filed: Apr. 2, 1976

[21] Appl. No.: 673,164

Related U.S. Application Data

[63] Continuation of Ser. No. 579,990, May 22, 1975, Pat. No. 3,976,124, which is a continuation-in-part of Ser. No. 411,983, Nov. 1, 1973, Pat. No. 3,904,233.

[52] U.S. Cl. ..... 166/120; 166/216

[51] Int. Cl.[2] ..... E21B 23/00

[58] Field of Search ..... 294/92, 102 A; 24/263 LL; 166/120, 118, 134, 140, 121, 212, 216, 217

[56] References Cited

UNITED STATES PATENTS

| | | | |
|---|---|---|---|
| 1,551,214 | 8/1925 | Perrel | 294/92 |
| 2,363,228 | 11/1944 | Cade | 294/92 X |
| 3,548,936 | 12/1970 | Kilgore et al. | 166/134 X |
| 3,695,352 | 10/1972 | McGill | 166/134 X |
| 3,714,984 | 2/1973 | Read | 166/134 |
| 3,804,166 | 4/1974 | Fisher et al. | 166/134 X |
| 3,818,987 | 6/1974 | Ellis | 166/134 |
| 3,851,707 | 12/1974 | Jett | 166/134 X |

*Primary Examiner*—Ernest R. Purser
*Assistant Examiner*—Richard E. Favreau
*Attorney, Agent, or Firm*—Michael J. Caddell

[57] ABSTRACT

One or more unitary, internally toothed sleeves are located in a packer mechanism in partially slidable relationship on the packer mandrel such that actuation of the packer serves to rotate the locking sleeves on the mandrel, causing the internally toothed sections to engage the mandrel and maintain the packer in the set position.

3 Claims, 10 Drawing Figures

MANDREL LOCKING SLEEVE

CROSS-REFERENCE TO RELATED APPLICATIONS

This application is a continuation of an earlier filed copending application, Ser. No. 579.990, filed May 22, 1975, by Robert Frank Berry, entitled MANDREL LOCKING SLEEVE; now U.S. Pat. No. 3,976,124, issued Aug. 24, 1976 which earlier filed copending application is a contiuation-in-part of an original application, Ser. No. 411,983, now U.S. Pat. No. 3,904,233 filed Nov. 1, 1973, and issued on Sept. 9, 1975, by Robert Frank Berry, entitled TUBING SUSPENSION HANGER.

BACKGROUND OF THE INVENTION

Normally, when running a pipe or rod string into or out of a borehole, a clamping device is utilized to suspend the string in the hole while another joint or section is threaded onto the top of the string or removed from the string.

In the past, these clamping devices have consisted of toothed clamping collars which are levered against the casing by external levers and linkages. An example of this type device is shown in U.S. Pat. Nos. 1,552,062 and 1,654,866. Other types of clamps utilize conical toothed inserts located in a tapered cylinder which are wedged against the tubing or rod. An example of this device is shown in U.S. Pat. No. 1,017,305.

The deficiencies of these devices include their complexity, their inability to hold properly under all conditions, and the difficulty of installing from the middle of a long string section when the ends of the string are not readily accessible.

This invention solves the above problem by providing an inner toothed, generally cylindrical, unitary gripping member located concentrically and pivotably in a flanged container or abutment housing and encircling the pipe or rod to be clamped and suspended. The invention utilizes the pipe strings own weight to establish a rotational moment in the gripping member which forces the gripping member toward gripping engagement with the tubing or rod string.

This invention also provides a gripping member particularly advantageous for use in a well packer for gripping engagement with the packer mandrel to prevent unsetting of the packer. The gripping means used in the prior art devices utilize multiple wedge inserts having internal teeth therein. These wedge inserts are driven inward against the mandrel by externally applied forces acting on a cammed driver sleeve which slides up on the sloping faces of the wedge inserts thereby driving them inward. The actuating force on this type of gripping means must be constantly maintained or else slipping of the mandrel and unsetting of the packer will occur. Any additional forces on the packer tending to unset it, such as formation pressure surges, require an accompanying increase in force to be applied externally to the wedge inserts to prevent unsetting of the packer by the pressure surge.

This invention overcomes this disadvantage by providing an unitary gripping sleeve with dual axis bore passage therethrough; with a portion of said bore passage having internal gripping teeth therein. The sleeve locks against the mandrel by rotating against it and is arranged such that surge forces and compressive forces in the packer elements serve to rotate the sleeve into even tighter engagement with the mandrel thereby preventing unsetting of the packer.

DESCRIPTION OF THE PREFERRED EMBODIMENTS

Figure 2:
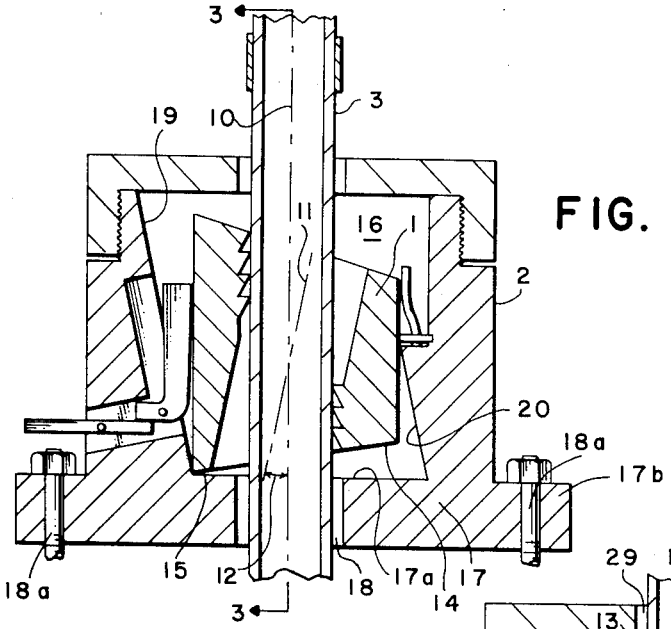
FIG. 2 illustrates the apparatus of FIG. 1 in a gripping position on the tubing.
Figure 1:
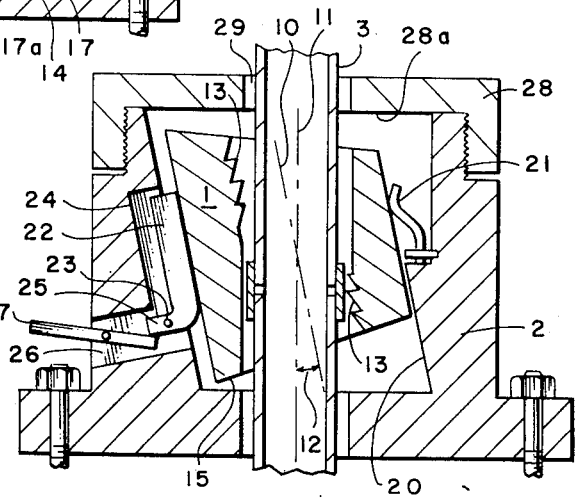
FIG. 1 illustrates a cross-sectional side view of the apparatus in a relaxed nonengaged position.
Figure 3:
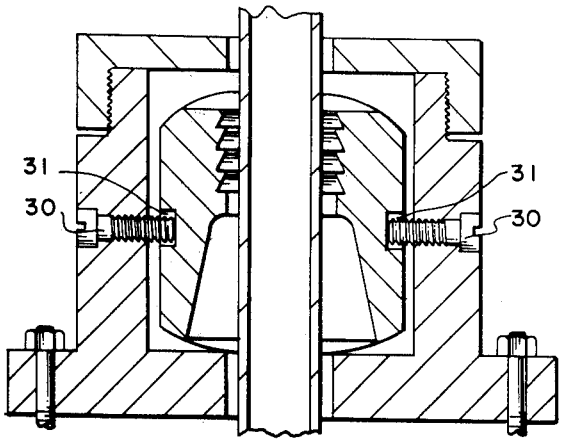
FIG. 3 illustrates a cross-sectional view of the apparatus taken at line 3—3 of FIG. 2.

Referring particularly to FIGS. 1–3, the invention is disclosed as having a tubular, generally cylindrical gripping sleeve 1 located fairly loosely within a sleeve chamber or abutment housing 2. The gripping sleeve is also located slidably on the tubing or rod string 3 which passes through the apparatus. The gripping sleeve 1 has a dual axis bore passage passing longitudinally therethrough with one axis 10 being generally coaxial with the central longitudinal cylindrical axis of the sleeve. A second portion of the bore passage is a cylindrical bore having a canted axis 11 intersecting the bore of axis 10 at an acute angle 12. Angle 12 may vary from about 5° up to about 45° and preferably is from 17 to 25°.

The location of two cylindrical bore passages within the gripping sleeve, with their axes at an angle to each other, allows the partial pivoting of the sleeve in the housing 2 about the rod or tubing string 3.

In FIG. 1, the sleeve is shown in the relaxed, nonengaging orientation with the canted axis 11 aligned with the central longitudinal axis of the pipe string passing through the sleeve. In FIG. 2, the pipe string axis coincides with axis 10 of the sleeve.

The bore passage formed along axis 10 contains a plurality of gripping teeth 13 formed as circumferential annular ridges on the inner wall of the sleeve in that portion of bore passage 10 not coinciding with bore passage 11.

Each tooth or ridge 13 has an upper surface at an angle of from 60 to 90 degrees to axis 10 and a lower slanted face going downward to the next adjacent tooth. The teeth are specifically arranged with the substantially perpendicular faces on the upper side so that the teeth will bite into the tubing or rod when it attempts to move downward against the teeth, but will be cammed out away from the tubing or rod when it moves upward against the teeth. This allows the rod or tubing to be moved upward through the apparatus at any time regardless of the position of sleeve 1.

The sleeve has a canted lower end 14 and an abutment shoulder 15, the upper surface of sleeve 1 may also be canted slightly or may be normal to axis 10.

The sleeve is contained in a hollow chamber 16 inside abutment housing 2. The housing may be polygonal or cylindrical in configuration. It contains a bottom plate 17 having a bore passage 18 therethrough for receiving the tubing or rod string 3. The remainder of bottom plate 17 serves to form an inwardly projecting annular abutment shoulder 17*a* which selectively abuts shoulder 15 of sleeve 1.

Bottom plate 17 has an outwardly projecting annular flange 17*b* having bolt holes 18*a* passing therethrough. Flange 17*b* is adapted to allow the abutment housing to be bolted to a permanent structure, frame, drilling table, or wellhead via bolts passing through holes 18*a*.

The housing inner walls may be canted, as at 19 and 20, to allow pivoting movement of sleeve 1, within the housing without causing interference between the housing and the sleeve.

Attached to one side of the inner chamber 16 is a curved leaf spring 21 attached to the housing and resiliently abutting sleeve 1, tending to continuously urge the gripping sleeve into the canted, non-engaging orientation as shown in FIG. 1.

An actuating arm 22 is pivotally pinned at 23 in a recessed area 24 in the wall of the housing. Arm 22 has an activating lever 25 projecting partially through a radial opening 26 in the housing wall from the pivot pin 23 and at approximately a right angle with arm 22.

An operating lever 27 extends partially through opening 26 and abuts lever 25 such that downward force on lever 27 is transferred into lever 25 and into arm 22 moving it inward into the housing against sleeve 1 which in turns pivots the sleeve in the housing to the position shown in FIG. 2.

An upper abutment head 28 is secured to the housing 2 and provides a top closure 28*a* to the chamber 16 and an opening 29 for the tubing string 3. Head 28 may be threadedly attached to housing 2 or by bolts, weldment, or any other suitable means.

FIG. 3 illustrates the structure of FIG. 2 taken at line 3—3 of FIG. 2 and shows the gripping sleeve 1 pivotally attached to housing 2 by means of pivot pins 30 threadedly engaged in and passing through the wall of housing 2 and projecting inwardly into recesses 31 formed in the side of sleeve 2.

OPERATION OF THE FIRST EMBODIMENT

When it is desirable to utilize a clamping and/or suspension means for tubing or rod strings in a wellbore, the present invention is particularly advantageous and is placed in operation by inserting the sleeve 1 into housing 2, inserting the pivot pins 30, and attaching upper head 28. The apparatus may then be lowered over the upwardly projecting rod or tubing end or the string may then be lowered down through the apparatus.

The housing is then secured to rigid means such as a frame, wellhead, drilling table, etc., by attaching with bolts through holes 18*a* in flange 17*b* or by clamping means or other devices.

In the relaxed, non-engaging position as shown in FIG. 1, the bore axis 11 of the sleeve is aligned with the central axis of the tubing string and there is sufficient room in bore 11 of sleeve 1 to pass tubing and connector collars unhindered therethrough.

When the string has been lifted or lowered, the required distance through sleeve 2 and it is then desired to let the string hang by its own weight suspended in the wellbore, the lever 27 is depressed downward, moving arm 22 against sleeve 1 thereby pivoting it about pins 30 until teeth 13 are brought into contact with the tubing. Then the weight is eased down on the tubing forcing abutment shoulder 15 against inner shoulder 17*a* of bottom plate 17. This junction of one side of the bottom of sleeve 1 with the plate 17 applies a rotational moment to the sleeve, forcing it into further pivotal movement toward the string and causing teeth 13 to bite into the wall of the string thereby securely gripping the string and holding it there. The perpendicular faces of the teeth are arranged to bite deeper into the tubing string increasing application of downward force and the sloped lower faces of the teeth allow them to be cammed out of engagement with the tubing upon upward movement of the string through the sleeve. Such an upward movement removes the rotational moment from the sleeve and spring 21 urges the sleeve into the canted non-engaging position once again. Should the sleeve adhere to the string as it moves upward, it will be dislodged by abutment with head 28 and return to its non-engaged position.

ALTERNATE EMBODIMENTS

Figure 4:
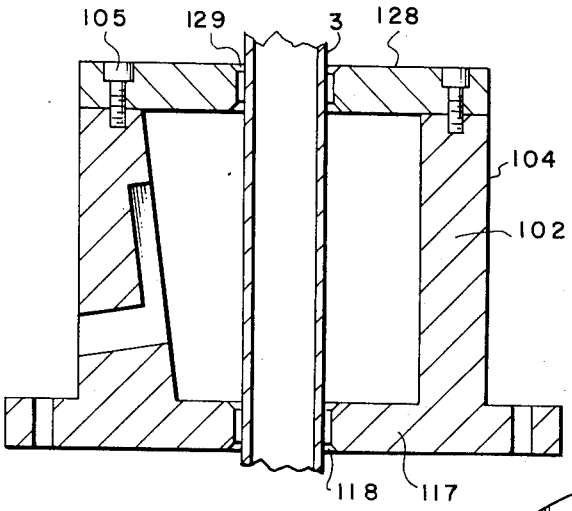
FIGS. 4 and 4*a* illustrate a cross-sectional side view and a top view of a different embodiment of the abutment housing.
Figure 5:
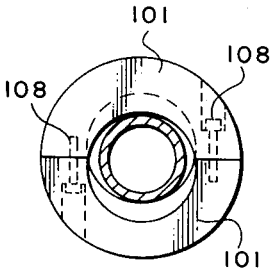
FIG. 5 illustrates a top view of a different embodiment of the gripping sleeve.
Figure 6:
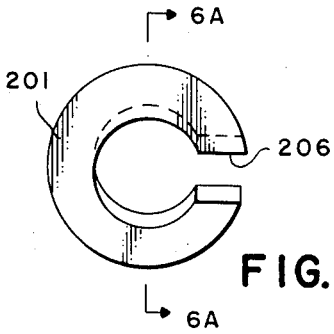
FIGS. 6 and 6*a* illustrates a top view and a cross-sectional side view of a third embodiment of the gripping sleeve.

Referring now to FIGS. 4–6, alternate constructions of the invention are illustrated, which embodiments are particularly advantageous when access to the end of the tubing string is hindered and it is desirable to place the clamping or suspension means on the string from the side rather than over the end.

In FIG. 4, an alternate housing construction is shown as having a lower abutment housing 102 with walls 104 and integral bottom plate 117. An upper head 128 is attached to housing 102 by removable means such as threaded bolts 105.

Upper head 128 has a central bore opening 129 for allowing passage of the tubing string 3 therethrough. Head 128 also has an entrance slot 106 passing therethrough and running from the central opening 129 radially outward to the outward circumference which allows the head to be slipped onto a tubing string from the side rather than having to go over the end of the tubing string.

Housing lower plate 117 likewise has a central opening 118 for allowing the tubing string 3 to pass therethrough unhindered. A radial slot 107 is formed through plate 117 from opening 118 through the circumference of the plate to allow the housing to be slipped onto the tubing string from the side as was the head 128.

Figure 4A:
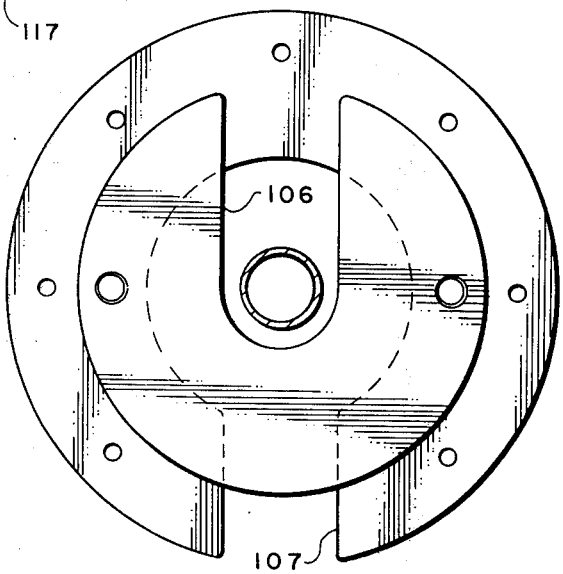

After the housing and upper head have been placed on the tubing string and before the head is attached to the housing, the upper head will be rotated on the string about 180° to move slot 106 diametrically opposite slot 107 and prevent the housing from coming off the tubing string. This relationship is shown in the top view shown in FIG. 4*a*.

Figure 6A:
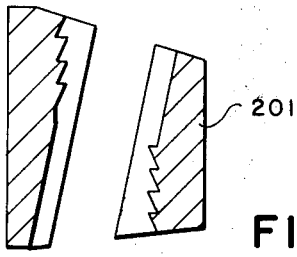

FIGS. 5, 6 and 6*a* show two embodiments of the gripping sleeve which will allow placement of the sleeve on the tubing string from the side rather than over the end of the tubing. In FIG. 5, the sleeve 101 is formed in two halves or is manufactured in one piece and later cut in half so that it can be placed about the tubing and then the halves rejoined together by securing them with means such as bolts 108.

FIGS. 6 and 6*a* illustrate a top and cross-sectional side view respectively of a gripping sleeve 201 which has been formed similar to the sleeve 1 of FIGS. 1–3, but having the additional feature of a longitudinal slot 206 running from the central bore passage through the outer wall of the sleeve 201 along the entire length of the sleeve to allow it to be slipped over the tubing string from the side.

Once the string 201 has been slipped over the tubing and located in housing 102, it will be prevented from moving sideways off of the tubing by the physical confinement of the housing walls and upper and lower head plates plus pivot pins in the housing wall similar to pins 30 in FIG. 3.

After the housing and sleeve have been slipped on the tubing string and assembled in place with the upper head attached to the housing, the operation of the apparatus is similar to that of the embodiments of FIGS. 1–3.

Figure 8:
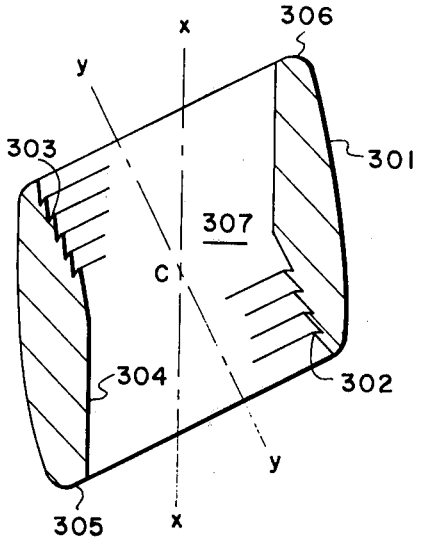
Figure 7:
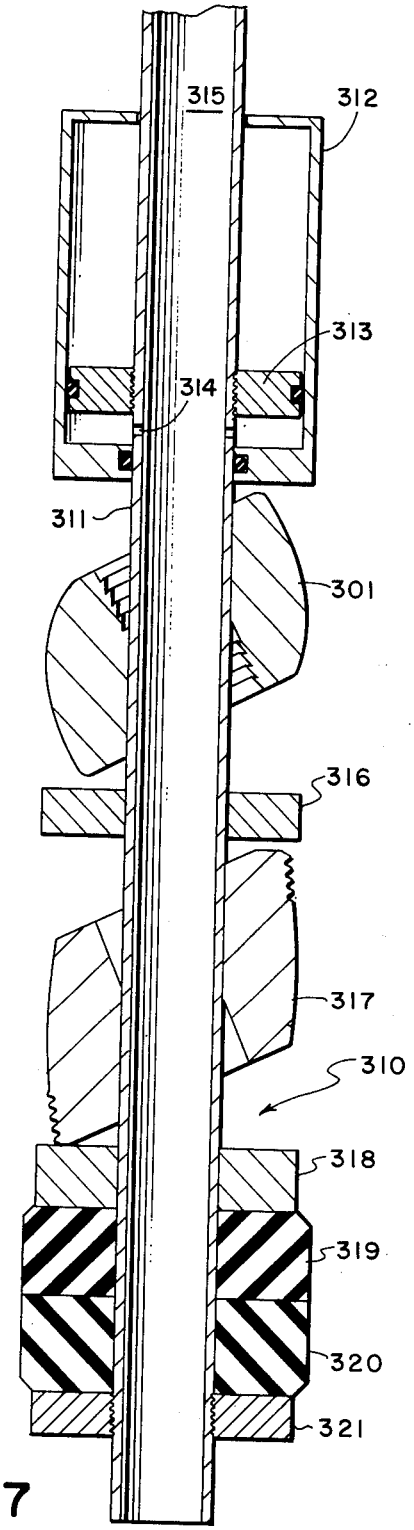
FIG. 7 illustrates another embodiment of the invention shown in schematic diagram; and, FIG. 8 is an enlarged cross-sectional view of the embodiment of FIG. 7.

Referring now to FIGS. 7 and 8, another embodiment of tubular gripping sleeve 301 is shown for use as a mandrel anchor in a well packer 310.

The tubular gripping sleeve 301 is slidably mounted externally on a tubular packer mandrel 311 below a hydraulic setting cylinder 312 which is slidably and sealingly mounted on mandrel 311. An annular flange 313 is secured to mandrel 311 inside cylinder 312 and sealingly abuts the inner wall thereof. One or more ports 314 pass through the wall of mandrel 311 and communicate the area between the lower end of cylindrer 312 and flange 313 with the inner bore 315 of mandrel 311.

A slidable abutment plate 316 is located on mandrel 311 below sleeve 301. A tubular well gripping member 317 is located slidably and partially rotatably on mandrel 311 below abutment plate 316. Gripping 317 may be of the type disclosed in U.S. Pat., Nos.: 3,548,936; 3,739,849; and 3,851,705.

A lower expander plate 318 is slidably mounted on mandrel 311 and rests on elastomeric well packer elements 319 and 320 which are adapted to be compressed longitudinally into radial expansion against the well casing inner wall. A bottom compression plate 321 is secured to mandrel 311 and provides a stationary surface against which compression of the packer elements may be accomplished by means of hydraulic actuation of cylinder 312.

FIG. 8 shows a close-up view of the tubular gripping sleeve 301. This member is preferably formed in a generally cylindrical configuration and has located therethrough a dual axis bore passage 307. The two intersecting axes of passage 307 are shown at X—X and Y—Y, which axes intersect at or near the center of rotation C of the member.

The tubular bore 304 defined by axis X—X is a smooth bore adapted to receive mandrel 311 in slidable relationship. The bore defined by axis Y—Y utilized toothed sections 302 and 303 for gripping engagement with mandrel 311 when the member 301 is rotated so that axis Y—Y generally coincides with the central longitudinal axis of mandrel 311.

The gripping sleeve 301 is provided at the upper and lower ends with abutment surfaces 306 and 305 which are arranged for abutting contact with cylinder 312 and plate 316. When such abutment occurs, for example as a result of hydraulic actuation of cylinder 312, a clockwise moment of rotation about center C is established in sleeve 301 which pivots axis Y—Y toward alignment with the longitudinal axis of mandrel 311. This simultaneously engages gripping teeth 302 and 303 with mandrel 311. It should be noted that the toothed sections 302 and 303 preferably are formed so that the teeth point in a generally upward direction to allow downward sliding movement of the teeth over the mandrel and biting engagement of the teeth into the mandrel upon upward motion of the sleeve against the mandrel.

In typical operation, the well packer is lowered into the borehole in a string of tubing until the packer is properly positioned in the hole. A plug or ball is dropped to seat in the packer or the tubing string below the packer, thereby closing off the inner bore of the toolstring.

Hydraulic pressure in the tubing acts through ports 314 against flange 313 and cylinder 312, driving the cylinder downward against gripping sleeve 301. Due to the upward slant of the teeth in sleeve sections 302 and 303, sleeve 301 will react by pivoting about C and sliding downward on mandrel 311 until plate 316 is contacted. The downward movement of sleeve 301 drives the slip 317 downward simultaneously compressing the packer elements 319 and 320 and rotating the slip into engagement with the casing.

After the release of the hydraulic pressure on the tubing, the resiliency of the packer elements will provide a continuous downward biasing force on lower plate 321, which force will be transferred therethrough to mandrel 311. The downward pull on mandrel 311 insures a secure engagement of the mandrel with the teeth in sleeve 301 which engagement is further aided by the moment of rotation generated by the contact of surface 305 with plate 316.

Thus, it can be seen that any errant force attempting to pull the mandrel downward to disengage the slip 317 and elements 319 and 320 from the casing wall will serve only to further set the anchor sleeve 301 against the mandrel and maintain the slip and packer elements in their expanded engaged position.

Although it is not necessary to the operation of this invention, it is possible to further add additional hydraulic actuating cylinder means below the packer elements in order to provide an upward compression force thereagainst, simultaneously with the downward force created by cylinder 312. This could be accomplished by using an additional set of ports in mandrel 311, by replacing bottom flange 321 with a sliding flange and an inverted cylinder and piston similar to 312 and 313, and by seating the plug or ball therebelow so that pressurization of the tubing string will actuate both hydraulic cylinders simultaneously. This would provide for further compression of elements 319 and 320 after setting of the slip 317 in the casing. Furthermore, an additional locking sleeve similar to sleeve 301 could be located between such lower hydraulic cylinder arrangement and the packer elements in an inverted orientation to provide locking action against unsetting of the expanded packer elements.

It is also clear that this invention could be utilized in dual string packers such as that disclosed in U.S. Pat. No. 3,851,707 by forming the locking sleeve with two parallel dual axis bore passages therethrough to receive the two mandrels of the dual string packer, much the same as the gripping slip of the aforementioned U.S. Patent utilizes two dual axis bore passages.

Although certain preferred embodiments of the present invention have been herein described in order to provide an understanding of the general principles of the invention, it will be appreciated that various changes and innovations can be afffected in the described tubing or rod hanger apparatus without departure from these principles. For example, although the housing and gripping member are both depicted as being cylindrical, it is clear that there are many possible physical configurations for these elements, such as polygonal or spherical. Also other spring means than the leaf spring shown could be used between the housing and sleeve, for instance coil springs or belleville springs would be operable therein. All modifications and changes of this type are deemed to be embraced by the spirit and scope of the invention except as the same may be necessarily limited by the appended claims or reasonable equivalents thereof.

The embodiments of the invention in which an exclusive property or privilege is claimed are defined as follows:

1. A mandrel gripping sleeve comprising:

a generally cylindrical member having a dual axis bore passage therethrough and adapted for slidable and partially rotatable engagement on a mandrel;

said dual axis bore passage having a first axial bore passage with relatively smooth walls, and a second axial bore passage with internally toothed sections; and, said member having abutment means thereon, arranged when externally abutted, to induce a rotational moment in said member such that said member is induced to rotate said second axial bore passage toward the mandrel passing through said member.

2. The mandrel gripping sleeve of claim 1 wherein said first and second axial bore passages intersect each other at an acute angle and said second bore passage substantially coincides with the central longitudinal axis of said generally cylindrical member.

3. The mandrel gripping sleeve of claim 2 wherein said first and second axial bore passages intersect generally at the center of rotation of said member.

* * * * *